US006378860B1

(12) United States Patent
Gutierrez et al.

(10) Patent No.: US 6,378,860 B1
(45) Date of Patent: Apr. 30, 2002

(54) COLLECTION TRAY OVERLOAD DETECTION AND RECOVERY

(75) Inventors: Hernan Gutierrez; Antonio Martinez; Raul Ocampo, all of Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/358,377

(22) Filed: Jul. 21, 1999

(51) Int. Cl.[7] ..... B65H 31/10

(52) U.S. Cl. ..... 271/217; 271/207; 271/176; 271/215; 271/265.04

(58) Field of Search ..... 271/217, 207, 271/176, 215, 265.04; 270/58.09

(56) References Cited

U.S. PATENT DOCUMENTS

| | | | | | |
|---|---|---|---|---|---|
| 4,835,573 | A | * | 5/1989 | Rohrer et al. | 355/308 |
| 4,960,272 | A | * | 10/1990 | Wierszewski et al. | 271/3.1 |
| 4,970,544 | A | * | 11/1990 | Furusawa et al. | 355/24 |
| 5,046,171 | A | * | 9/1991 | Ettischer et al. | 271/219 |
| 5,085,421 | A | * | 2/1992 | Sellers | 271/155 |
| 5,121,911 | A | * | 6/1992 | Yamazki et al. | 270/53 |
| 5,139,254 | A | * | 8/1992 | Yamashita et al. | 271/215 |
| 5,163,670 | A | * | 11/1992 | Sellers et al. | 271/157 |
| 5,201,517 | A | * | 4/1993 | Stemmle | 271/291 |
| 5,455,667 | A | * | 10/1995 | Hiroi et al. | 355/309 |
| 5,473,234 | A | * | 12/1995 | Richardson | 399/369 |
| 5,622,364 | A | * | 4/1997 | Dutton et al. | 271/117 |
| 5,640,232 | A | * | 6/1997 | Miyake et al. | 399/18 |
| 5,771,433 | A | * | 6/1998 | Kimijima | 399/369 |
| 5,839,015 | A | * | 11/1998 | Faguy et al. | 399/23 |

FOREIGN PATENT DOCUMENTS

| | | | | |
|---|---|---|---|---|
| JP | 11-116073 | * | 4/1999 | B65H/1/24 |

OTHER PUBLICATIONS

Xerox Technical Disclosure, Stack Weight Sensing Paper Tray, Stephen J. Wenthe, Jr. Jul. 1982.*

* cited by examiner

*Primary Examiner*—Christopher P. Ellis
*Assistant Examiner*—Michael E. Butler

(57) ABSTRACT

A system has a media handler to transports media (e.g., paper, transparencies, etc.) from an input bin through a processing unit to a collection tray. A tray adjustment mechanism moves the collection tray down and up as media is collected and occasionally removed by the operator. An overload detector detects an overload condition when the media stack on the tray becomes too heavy. The overload detector indirectly measures the stack weight by measuring the speed of the tray (or media stack) or alternatively, by monitoring the motor current. Once overload is detected, the system stops the tray to avoid damaging the tray adjustment mechanism and/or tray. The system notifies the operator via a visual message or an audible alarm. A recovery manager is then invoked to return the tray to the appropriate position after the operator has removed the media stack. In user-assisted recovery, the system awaits some explicit input from the operator that the media stack has been removed. Alternatively, the system may implement a self-recovery in which the system checks whether the media stack has been removed by periodically attempting to move the collection tray. If the operator has not removed the stack, the tray will not move. But, if the operator has removed the media stack, the tray will be freed to move and can be recovered back to a proper operating position.

25 Claims, 4 Drawing Sheets

COLLECTION TRAY OVERLOAD DETECTION AND RECOVERY

TECHNICAL FIELD

This invention relates to systems with media handling devices, such as printers, photocopiers, facsimile machines, scanners, and the like. More particularly, this invention relates to techniques for detecting overload conditions on collection trays utilized by the media handling devices.

BACKGROUND OF THE INVENTION

Media handling devices facilitate media movement through a system. Typically, the media (e.g., paper, transparency, etc.) is transported from an input tray, through a media processing unit (e.g., scanning unit, printing mechanism, etc.), and output onto a collection tray. As collected, the media is commonly stacked sheet-by-sheet or job-by-job on the collection tray. In many conventional systems, the collection tray is manufactured using a low cost, durable material (e.g., plastic).

The media handling device may further include a tray adjustment mechanism that vertically moves the tray relative to the output slot. The tray is lowered as more sheets are deposited onto the stack and raised again after the operator removes an existing stack. The tray adjustment mechanism may be constructed using springs, motor, gears, belts, and/or other mechanical means to maneuver the tray relative to the output slot.

The tray and adjustment mechanism are designed to hold a specified maximum weight. A problem arises when the media stack collected on the tray exceeds this maximum weight, a condition known as "overload". For example, an operator may not notice the growing media stack on the collection tray and the combined weight of many sheets eventually exceeds the capacity of the collection tray, thereby triggering an overload condition. Another situation might be when the operator uses media of different weight and size. The system may not be able to discern the type and weight of the media and hence, may not be able to ascertain when the overload condition is approaching. When overload occurs, there is a possibility that the tray and/or adjustment mechanism may be damaged.

This invention addresses this overload problem in collection trays.

SUMMARY OF THE INVENTION

This invention concerns a system for detecting overload of a collection tray and recovering from the overload condition.

In one implementation, the system has a media handler that transports media (e.g., paper, transparencies, etc.) from an input bin through a processing unit to a collection tray. A tray adjustment mechanism moves the collection tray down and up as media is collected and occasionally removed by the operator. The tray adjustment mechanism is constructed, for example, using a mechanical coupling that attaches to the collection tray and a DC motor to drive the coupling and tray.

The system has a controller with an overload detector to detect when an overload condition arises and a recovery manager to recover from the overload condition. The overload detector indirectly measures the weight of the media collected on the collection tray by measuring the speed of the tray (or media stack) or alternatively, by monitoring the motor current. From this indirect weight measurement, the overload detector can ascertain whether the media stack on the tray is too heavy and will trigger an overload condition.

Once overload is detected, the controller stops the motor to avoid damage to the motor, coupling assembly, and/or tray. The controller then notifies the operator via a visual message and/or an audible alarm. The notification alerts the operator that the collection tray is overloaded and the media needs to be removed before operation can continue. The recovery manager is then invoked to periodically check whether the operator has removed the media and if so, return the tray to the appropriate position.

There are two different recovery situations: user-aided recovery and self-recovery. In user-aided recovery, the system awaits some explicit user input that the media stack has been removed, such as by requiring the operator to press a button or hold down a key. Self-recovery does not require explicit notice from the operator, but instead enables the system to check itself whether the media stack has been removed. With self-recovery, the recovery manager periodically attempts to move the collection tray. If the operator has not yet removed the stack, the tray will not move. But, if the operator has removed the media stack, the tray will be freed to move and can be recovered back to a proper operating position.

BRIEF DESCRIPTION OF THE DRAWINGS

The same reference numbers are used throughout the figures to reference like components and features.

DETAILED DESCRIPTION OF THE INVENTION

Figure 1:
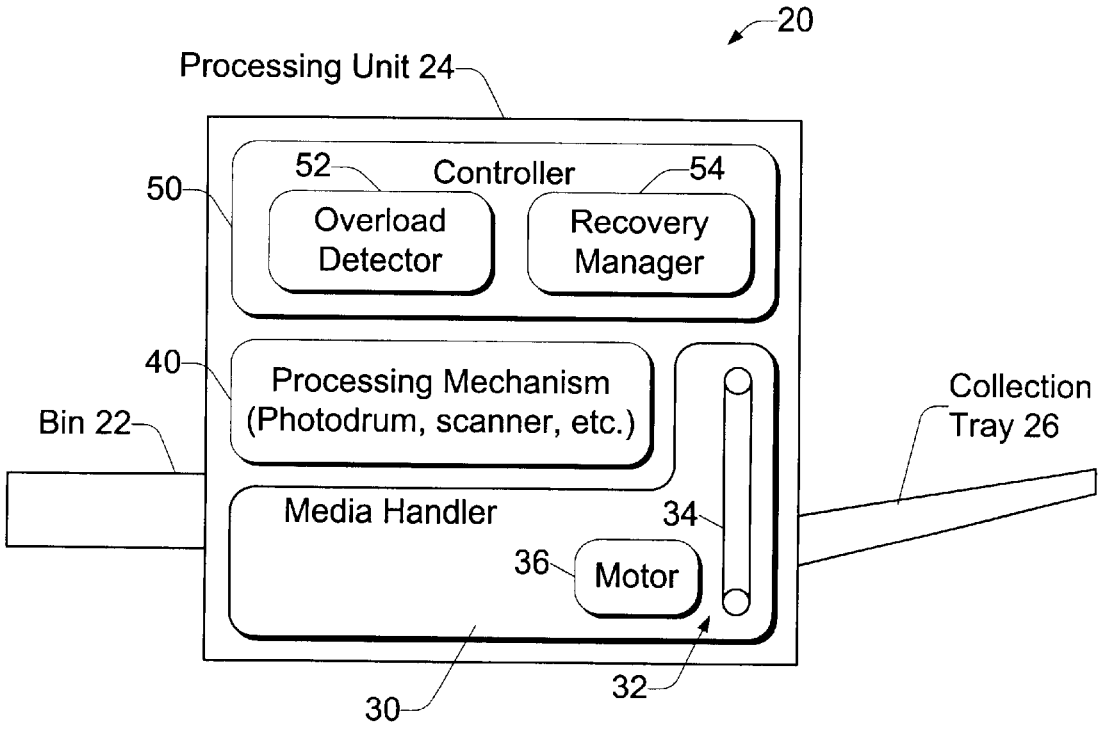
FIG. 1 is a diagrammatic illustration of a system with a media handling device.

FIG. 1 shows a media processing system 20 for processing media (e.g., paper, transparency, etc.). The media processing system may be embodied as one of many different products, including a printer, a scanner, a photocopier, a facsimile machine, and so forth. The media processing system 20 has an input bin 22 that stores media to be input into the system, a processing unit 24 that processes the media (e.g., scans the media, prints the media, etc.), and a collection tray 26 that collects the media after it is processed.

A media handler 30 transports the media from the input bin 22 through the processing unit 24 to the collection tray 26. The media handler 30 includes a media path having rollers, guides, and surfaces (not shown) that guide the media through the processing unit 24 and onto the collection tray 26. The collection tray 26 is vertically adjustable so that the upper surface of the tray or media stack can be maintained in close proximity to the output slot of the processing unit 24. The media handler 30 includes a tray adjustment mechanism 32 coupled to move the collection tray 26 up and down. In the illustrated implementation, the tray adjustment mechanism 32 has a mechanical coupling 34 formed of a belt and pulley assembly (or gear and drive train assembly) and a DC motor 36 to drive the mechanical coupling 34 to adjust the tray.

The media processing system 20 has a processing mechanism 40 to process the media in some manner as it is transported by the media handler. Examples of the processing mechanism include a scanner that scans the incoming media, a printing mechanism (e.g., photoconductive drum for laser printing, inkjet print heads, etc.) for printing images on the media, and the like.

The system 20 further includes a controller 50 that manages the processing operation. The controller 50 includes a processor, memory, and control circuitry (not shown) to manage the media throughput and timing of the processing.

The controller 50 has an overload detector 52 to detect an overload condition and a recovery manager 54 to recover from the overload condition. As noted in the Background, an "overload condition" arises when the media collected on the collection tray 26 exceeds a maximum weight supported by the collection tray 26, coupling 34, and drive motor 36. To avoid damaging the tray 26, coupling 34, and/or motor 36, the controller 50 shuts down the motor when an overload condition is detected.

After detecting overload, the controller 50 notifies the operator via a visual cue (e.g., message on a user interface screen, blinking light) or an audible alarm. The notification alerts the operator that the collection tray is too full and the media needs to be removed before operation can continue. The recovery manager 54 is then invoked to return the tray to the appropriate position after the operator has removed the media stack from the tray.

The overload detector 52 and recovery manager 54 may be implemented in software, firmware, and/or hardware. The overload detection phase and recovery phase are described below in more detail.

Figure 2:
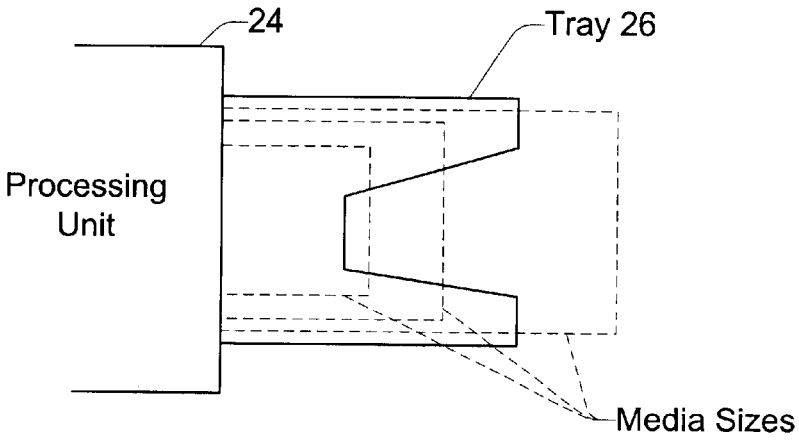
FIG. 2 is a diagrammatic illustration of the system and shows a top view of a collection tray.

FIG. 2 shows a top view of the collection tray 26 and exemplary sizes of media that can be collected. The collection tray is designed to hold at least the amount of media of the specified weight and size. For instance, the media may be single sheets of paper, ranging in size from A5 (210 mm by 148 mm) up to A3 size (297 mm by 420 mm). The collection tray is further designed to hold a wide variety of weights, with maximum capacities ranging from 16 lb. up to 28 lb. One exemplary specification calls for the tray to hold a maximum of 3000 sheets of A4 paper at 80 g/m$^2$.

The tray adjustment mechanism 32 is designed to move the tray 26 any time it is loaded with a quantity of paper that does not exceed the specified maximum weight. The DC motor 36 is equipped with a current limiting circuit that restricts the maximum current to a limit that permits movement of the tray at the specified maximum weight, but no more. The current limiting circuit helps avoid permanent damage to the motor as a result of an overload condition.

With reference again to FIG. 1, the overload detector 52 is configured to detect an overload condition and stop the motor. The overload detector 52 indirectly measures the weight of the media collected on the collection tray 26. More specifically, the overload detector 52 measures the speed of the tray (or media stack) or alternatively, monitors the motor current as techniques to gage the weight of the media on the tray. From this indirect weight measurement, the overload detector can ascertain whether the media stack on the collection tray 26 is too heavy and will trigger an overload condition.

Figure 3:
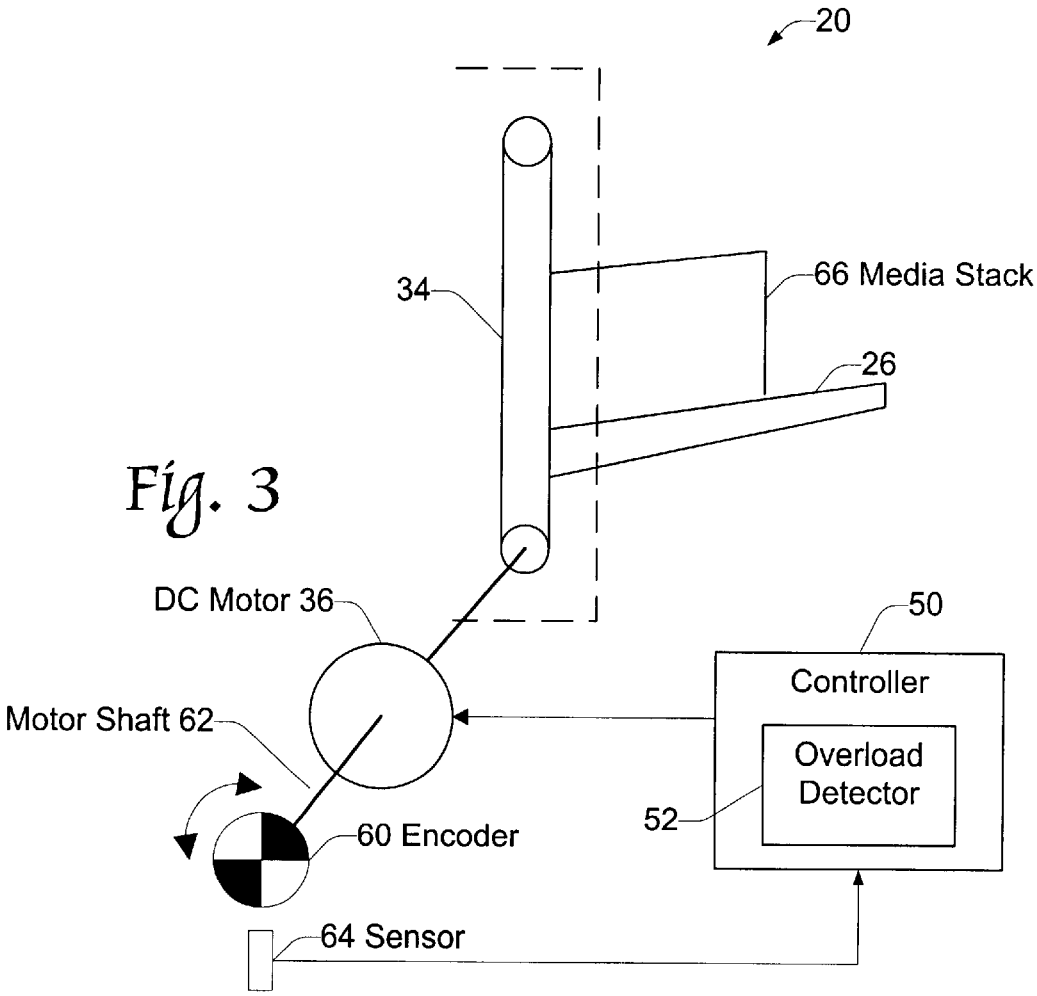
FIG. 3 is a diagrammatic illustration of a collection tray assembly and overload detection unit according to a first implementation.

FIG. 3 shows a first implementation of the media processing system 20 in which the overload detector 52 monitors the speed of the collection tray 26. The system is equipped with an encoder disk 60 that moves in relation to movement of the collection tray 26. The encoder disk 60 may be added to any shaft or coupling that moves as the motor 36 raises and lowers the tray 26. In FIG. 3, the encoder disk 60 is attached to a motor shaft 62 of motor 36, which drives the adjustment coupling 34. A sensor 64 is positioned to sense movement of the encoder disk 60. In this implementation, the sensor 64 is an optical sensor that detects changing surface colors on the encoder disk 60 as the disk rotates. In another implementation, the encoder disk may have apertures evenly spaced around the periphery and the sensor may be embodied as an "H" sensor that detects a light beam periodically passed through the apertures as the disk rotates. It is noted that other types of sensors and encoder disks may also be used.

Figure 4:
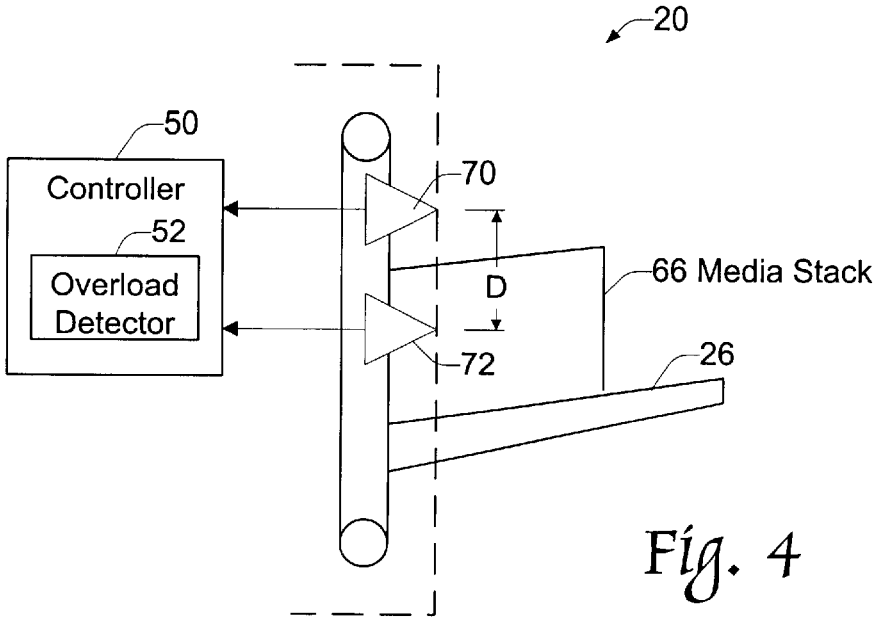
FIG. 4 is a diagrammatic illustration of a collection tray assembly and overload detection unit according to a second implementation.

As the motor 36 raises and lowers the tray 26, the encoder disk 60 rotates and the sensor 64 generates a changing signal as it senses the transitioning surface colors. The signal may be analog or digital. The sensor 64 sends the signal to the overload detector 52 of the controller 50. From this signal, the overload detector 52 can discern the speed at which the tray 26 is moving and hence, the approximate weight being supported by the tray. That is, as the measured speed increases or slows, there is correspondingly less or more weight on the tray. As the speed slows to a prescribed limit or stops altogether (i.e., indicating that the weight of media stack 66 exceeds the pre-specified weight), the controller 50 asserts an overload condition and alerts the user through a visual and/or audio warning. FIG. 4 shows a second implementation of the media processing system 20 in which the overload detector 52 monitors the speed of travel for the collection tray 26 by measuring the time it takes for the tray to move from one fixed point to another. The overload detector 52 has at least two sensors 70 and 72 positioned to sense movement of the media stack 70. The sensors are spaced apart by a distance D. If desired, an array of three or more sensors may be aligned vertically and spaced closer together than distance D to enable smaller measurement intervals and a wider range of coverage along the media stack 66. Moreover, the sensors may be positioned to sense movement of the tray, rather than the media stack 66.

In the case of two sensors (or any two adjacent sensors in an array), the controller 50 directs the motor to move the tray down until the top of the media stack 66 is beneath the bottom sensor 72. At this point, both sensors 70 and 72 are deactivated. The controller 50 then directs the motor 36 to drive the tray 26 upwards. When the top of the media stack 66 reaches the bottom sensor 72, the bottom sensor 72 is activated and sends a signal to the controller 50. As the stack 66 continues up, it eventually triggers the upper sensor 70, which also sends a signal to the controller 50.

The overload detector 52 measures the time delay T between receiving the signal from the lower sensor 72 and the signal from the upper sensor 70. The overload detector 52 then derives the tray speed $V_{tray}$ as the distance D divided by the time delay T (i.e., $V_{tray}$=D/T). When the speed decreases to a predetermined point, the controller 50 asserts the overload condition and warns the user to remove the stack 66 from the tray 26.

A variation of this technique is to simply base the analysis on the duration of T. If the tray is unable to move up as a result of a heavy load, the time delay T between sensors will be very long. The overload detector 52 may be configured to trigger an overload condition in the event that the delay T exceeds some maximum period.

It is noted that the two implementations FIGS. 3 and 4 may be configured to detect an "early overload condition", prior to actual overload. As both implementations essentially measure tray speed, which is directly impacted by the stack weight on the tray, the overload detector may monitor for values indicating that the tray is nearing full capacity (i.e., 90% or 95% full). For example, the encoder disk 60 of FIG. 3 may rotate at a slowing speed suggesting that the stack is becoming too heavy. Alternatively, the time delay T measured between sensors 70 and 72 in FIG. 4 may be sufficiently long to suggest that the tray is almost overloaded.

In these situations, the controller 50 may be configured to announce an early warning condition by way of visual or audio cues that are different from those used to announce the overload condition. This early warning may be used by the operator to remove the existing stack 66 before an actual overload condition is reached.

Figure 5:
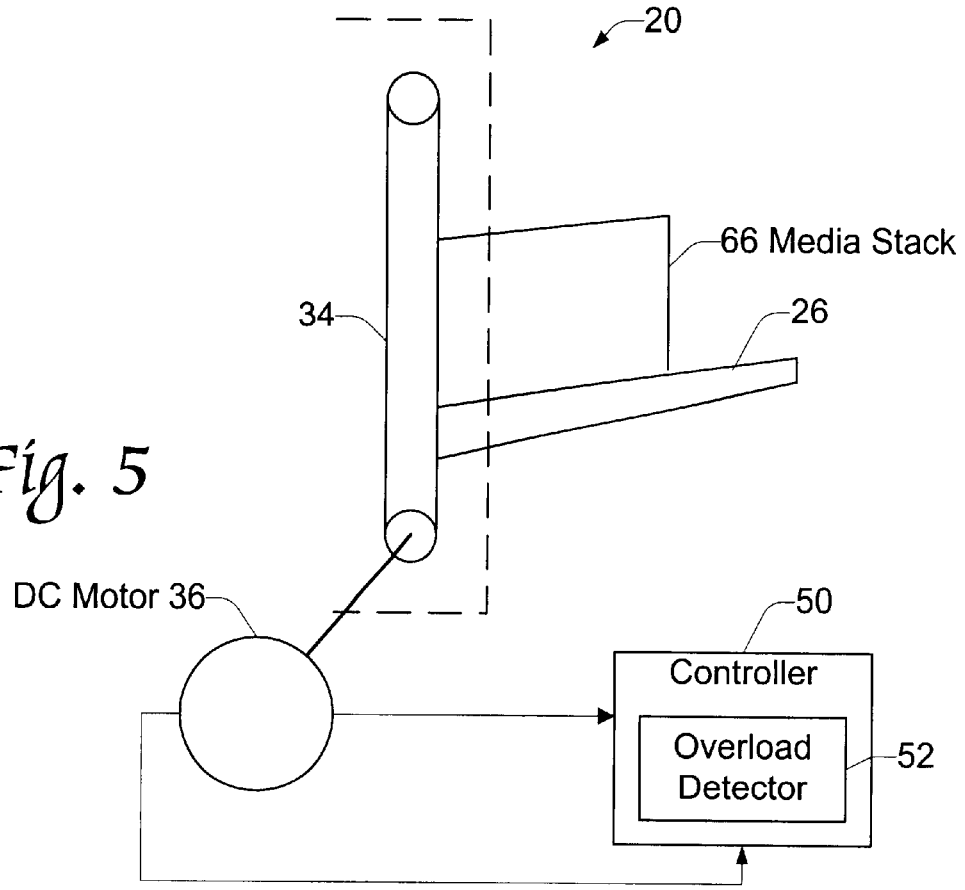
FIG. 5 is a diagrammatic illustration of a collection tray assembly and overload detection unit according to a third implementation.

FIG. 5 shows a third implementation of the media processing system 20 in which the overload detector 52 monitors the current used by the motor 36. The current used by DC motor 36 is proportional to the torque applied to the coupling assembly 34 and tray 26. The overload detector 52 detects the overload condition based on the current utilized in the motor 36 or changes in the current. Once detected, the controller notifies the operator.

Figure 6:
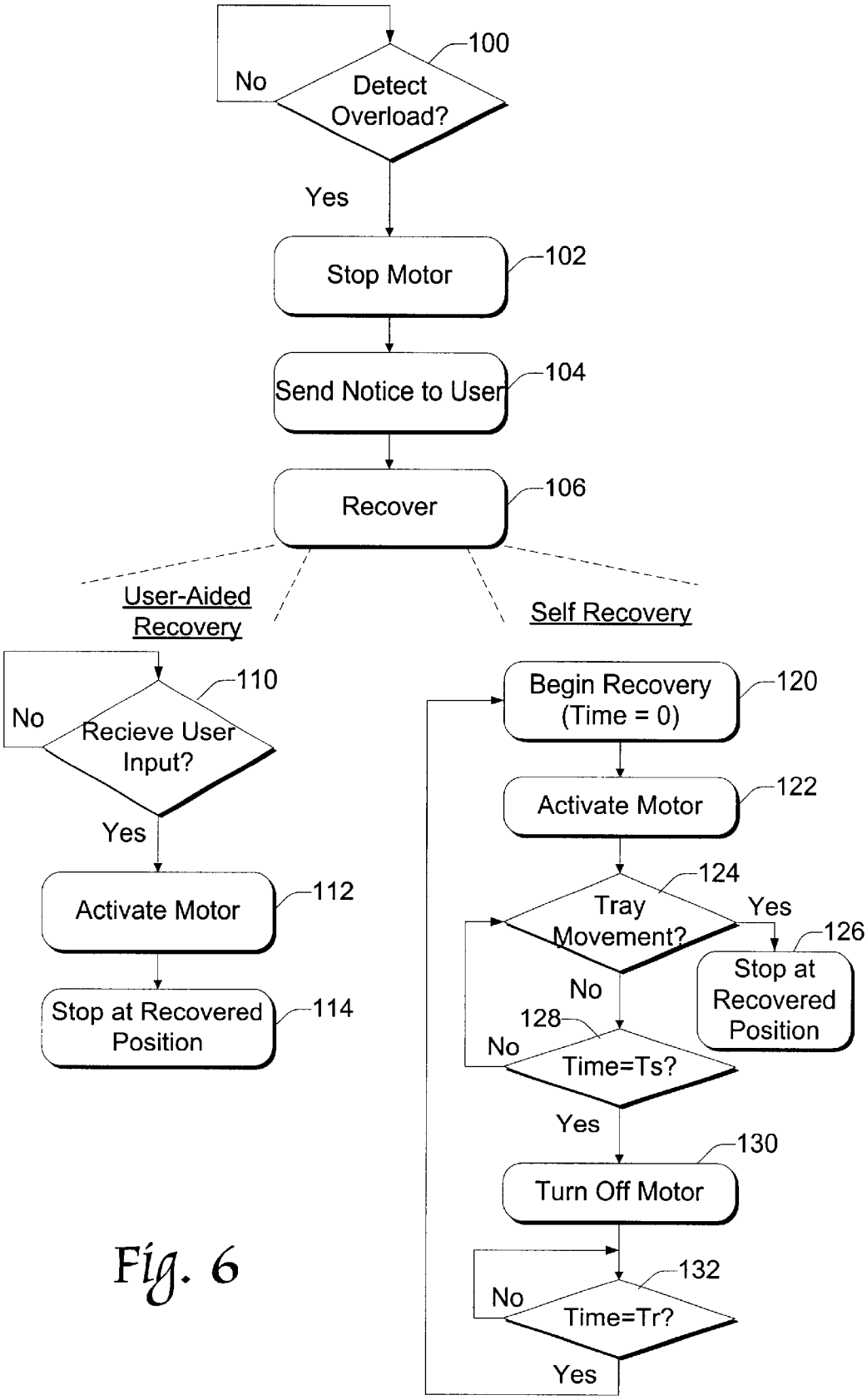
FIG. 6 is a flow diagram showing a recovery process for recovering from an overload condition.

FIG. 6 shows the detection and recovery process executed by the media processing system 20. The process can be implemented in software and/or hardware.

At step 100, the overload detector 52 continually monitors for overload using, for example, one of the techniques described above with respect to FIGS. 3–5. Once an overload condition is detected, the controller 50 stops the motor 36 to avoid damaging the system (step 102). The controller 50 then notifies the operator via a visual message or an audible alarm (step 104). The message and/or alarm inform the operator to remove the media stack from the collection tray. After this notification, the controller 50 enters a recovery phase (step 106).

There are two different recovery situations: user-aided recovery and self-recovery. In user-aided recovery, the system awaits some explicit input from the operator that the media stack has been removed (step 110). The operator may be required to press a button, hold down a key, or take some other action that the system interprets as meaning that the media stack has been cleared.

In response to the user input, the controller 50 turns on the motor (step 112) to return the tray 26 to its proper position given its empty or near empty state. The controller 50 stops the tray 26 at the proper position and resumes normal operation, collecting more sheets output from the processing unit 24 (step 114).

Self-recovery does not require explicit notice from the user, but instead enables the system to check itself as to whether the media stack has been removed. With self-recovery, the recovery manager 54 periodically attempts to move the collection tray. If the operator has not removed the stack, the tray will not move. But, if the operator has removed the media stack, the tray will be freed to move and can be recovered back to a proper operating position.

Figure 7:
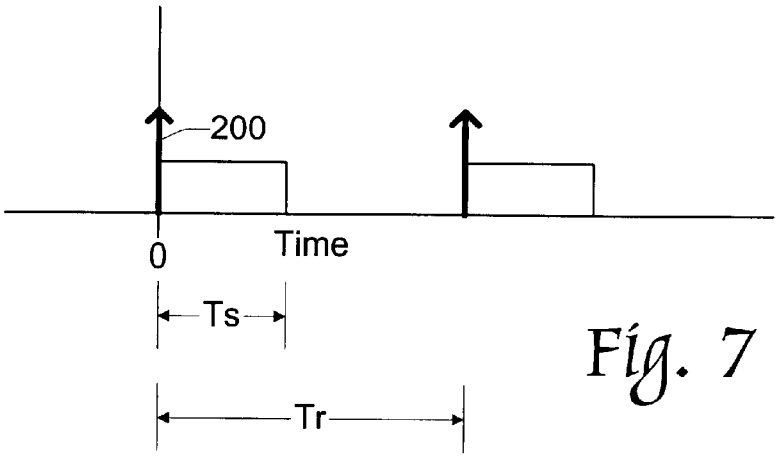
FIG. 7 is a timing diagram showing timing used in a self-recovery process.

One implementation of self-recovery is described with reference to steps 120–132 and with additional reference to the timing diagram of FIG. 7. The recovery manager 54 turns on the motor every period of time "Tr" to see if the tray moves (i.e., indicating that the operator has removed all or part of the media stack 66). The recovery manager 54 initiates a recovery attempt by turning on the motor 36 in an effort to move the tray upwards (steps 120 and 122). This corresponds to the first impulse 200 at time zero (i.e., Time=0) in FIG. 7. The motor is left on for time period "Ts", which is less than the period "Tr".

At step 124, the controller 50 receives feedback as to whether the tray has moved. If it has, the controller returns the tray to the appropriate position and stops the motor (step 126). On the other hand, if the tray has not moved, the recovery manager 54 checks whether the motor start interval "Ts" has elapsed (i.e., Time=Ts) (step 128). If not, the controller continues to check for tray movement.

Once interval "Ts" elapses without any tray movement, the controller 50 turns off the motor (step 130). The controller then waits for completion of period "Tr" (i.e., Time=Tr) before initiating another recovery attempt (step 132). The periods "Tr" and "Ts" are selected to ensure that the motor is not damaged as a result of the recovery process.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A collection tray unit for a media handling system, comprising:

a collection tray to collect media output from the media handling system;

a tray adjustment mechanism connected to the collection tray to facilitate movement of the collection tray; and an overload detector to detect an overload condition that occurs when a weight of the media collected on the collection tray exceeds a threshold weight, wherein the overload detector comprises multiple sensors positioned to sense movement of the collection tray or media stack thereon and a controller to detect the overload condition based on a speed at which the tray or media stack moves between the sensors.

2. A collection tray unit as recited in claim 1, wherein the tray adjustment mechanism comprises:

a mechanical coupling connected to the collection tray; and a motor to drive the mechanical coupling to adjust the tray.

3. A collection tray unit as recited in claim 1, wherein the overload detector detects the overload condition by measuring movement of the collection tray.

4. A collection tray unit as recited in claim 1, wherein the overload detector comprises:

an encoder coupled to move in relation to movement of the collection tray; and a sensor to measure movement of the encoder, the controller coupled to the sensor to detect the overload condition based on movement of the encoder.

5. A collection tray unit as recited in claim 1, wherein the overload detector notifies an operator of the overload condition.

6. A collection tray unit as recited in claim 1, further comprising a recovery manager to recover the collection tray unit following detection of the overload condition.

7. A collection tray unit as recited in claim 6, wherein the recovery manager periodically directs the tray adjustment mechanism to move the collection tray, whereby movement of the collection tray indicates that recovery is possible.

8. A media handling system incorporate the collection tray unit as recited in claim 1.

9. A media processing system incorporating the collection tray unit as recited in claim 1.

10. A collection tray unit for a media handling system, comprising:

a collection tray to collect media output from the media handling system;

a tray adjustment mechanism connected to the collection tray to facilitate movement of the collection tray; and an overload detector to detect an overload condition that occurs when a weight of the media collected on the collection tray exceeds a threshold weight, wherein the tray adjustment mechanism includes a motor and the overload detector comprises a current measuring unit to measure a current in the motor and to detect the overload condition based on the measured current.

11. A collection tray unit as recited in claim 10, wherein the overload detector notifies an operator of the overload condition.

12. A collection tray unit as recited in claim 10, further comprising a recovery manager to recover the collection tray unit following detection of the overload condition.

13. A collection tray unit as recited in claim 12, wherein the recovery manager periodically directs the tray adjustment mechanism to move the collection tray, whereby movement of the collection tray indicates that recovery is possible.

14. A media handling system incorporating the collection tray unit as recited in claim 10.

15. A media processing system incorporating the collection tray unit as recited in claim 10.

16. An apparatus, comprising:

a collection tray to collect media;

tray adjustment means for moving the collection tray; and overload detection means for detecting an overload condition based on movement of the collection tray, wherein the overload detection means comprises multiple sensors positioned to sense movement of the collection tray or media stack thereon and a controller to detect the overload condition based on a speed at which the tray or media stack moves between the sensors.

17. An apparatus as recited in claim 16, wherein the overload detection means comprises:

an encoder coupled to move in relation to movement of the collection tray; and a sensor to measure movement of the encoder, the controller coupled to the sensor to detect the overload condition based on movement of the encoder.

18. An apparatus as recited in claim 16, further comprising means for recovering from an overload condition by periodically trying to move the collection tray.

19. An apparatus as recited in claim 16 embodied as a media processing system.

20. An apparatus comprising:

a collection tray to collect media;

tray adjustment means for moving the collection tray; and overload detection means for detecting an overload condition based on movement of the collection tray, wherein the tray adjustment means includes a motor and the overload detection means comprises means for measuring a current in the motor as a way to monitor movement of the collection tray.

21. A method for detecting overload of a media collection tray, comprising:

measuring movement of the media collection tray; and determining whether an overload condition exists based on the movement of the media collection tray, wherein the media collection tray is driven by a motor, and the measuring comprises deriving a speed at which the media collection tray is moved.

22. A method as recited in claim 21, further comprising notifying an operator of the overload condition.

23. A method as recited in claim 21, further comprising recovering from the overload condition.

24. A method as recited in claim 21, further comprising recovering from an overload condition in which media collected on the media collection tray exceeds a prespecified maximum weight, the recovering including:

periodically starting the motor in an attempt to move the media collection tray;

in an event that the media collection tray can be moved, running the motor to return the media collection tray to a position that removes the overload condition; and in an event that the media collection tray cannot be moved, temporarily halting the motor for an interval prior to restarting the motor.

25. A method for detecting overload of a media collection tray, comprising:

measuring movement of the media collection tray; and determining whether an overload condition exists based on the movement of the media collection tray, wherein the media collection tray is driven by a motor, and the measuring comprises sensing a current in the motor and detecting the overload condition as a result of the measured current.

* * * * *